US005660938A

United States Patent [19]

Sato et al.

[11] Patent Number: 5,660,938

[45] Date of Patent: Aug. 26, 1997

[54] FE-NI-CR-BASE SUPERALLOY, ENGINE VALVE AND KNITTED MESH SUPPORTER FOR EXHAUST GAS CATALYZER

[75] Inventors: Koji Sato, El Cerrito, Calif.; Takehiro Ohno, Yasugi, Japan; Katsuaki Sato, Tochigi-ken, Japan; Tsutomu Saka, Kawagoe, Japan

[73] Assignees: Hitachi Metals, Ltd.,; Honda Giken Kogyo Kabushiki Kaisha, both of Tokyo, Japan

[21] Appl. No.: 623,026

[22] Filed: Mar. 28, 1996

Related U.S. Application Data

[63] Continuation-in-part of Ser. No. 292,019, Aug. 18, 1994, abandoned.

[30] Foreign Application Priority Data

Aug. 19, 1993 [JP] Japan ..... 5-204940
Mar. 25, 1994 [JP] Japan ..... 6-056219

[51] Int. Cl.[6] ..... C22C 38/44

[52] U.S. Cl. ..... 428/605; 148/327; 420/47; 420/53; 420/584.1; 420/586; 420/586.1

[58] Field of Search ..... 428/605; 420/47, 420/53, 584.1, 586, 586.1; 148/327

[56] References Cited

U.S. PATENT DOCUMENTS

| | | | |
|---|---|---|---|
| 3,183,084 | 5/1965 | Heydt et al. | 420/585 |
| 3,243,287 | 3/1966 | Lillys et al. | 420/586 |
| 3,552,950 | 1/1971 | Rundell et al. | 420/48 |
| 3,663,213 | 5/1972 | Eiselstein et al. | 420/584.1 |
| 4,035,182 | 7/1977 | Kowaka et al. | 420/584.1 |
| 4,172,742 | 10/1979 | Rowcliffe et al. | 148/38 |
| 4,743,318 | 5/1988 | Fischer et al. | 420/585 |
| 4,765,956 | 8/1988 | Smith et al. | 420/585 |
| 4,767,597 | 8/1988 | Nishinio et al. | 420/443 |
| 5,000,914 | 3/1991 | Igarashi et al. | 420/586 |
| 5,137,684 | 8/1992 | Fritzemeiar | 420/586 |

FOREIGN PATENT DOCUMENTS

| | | | |
|---|---|---|---|
| A2162596 | 7/1992 | Germany . | |
| 56-20148 | 2/1981 | Japan | 420/54 |
| 58-189359 | 11/1983 | Japan | C22C 38/50 |
| 60-211028 | 10/1985 | Japan | C22C 19/05 |
| 61-084347 | 4/1986 | Japan . | |
| 61-238942 | 10/1986 | Japan | C22C 38/54 |
| 62-214149 | 9/1987 | Japan | C22C 19/05 |
| 62-50542 | 10/1987 | Japan | C22C 30/00 |
| 63-213631 | 9/1988 | Japan . | |
| 1-12827 | 3/1989 | Japan | C22C 30/00 |
| 4-011613 | 3/1992 | Japan | C22C 19/05 |
| 170541 | 4/1965 | U.S.S.R. | 420/586 |

*Primary Examiner*—John Zimmerman
*Attorney, Agent, or Firm*—Sughrue, Mion, Zinn, Macpeak & Seas

[57] ABSTRACT

An FE—Ni—Cr-base superalloy consists essentially of, by weight, up to 0.15% C, up to 1.0% Si, up to 3.0% Mn, 30 to 49% Ni, 10 to 18% Cr, 1.6 to 3.0% Al, one or more elements selected from Groups IVa and Va whose amount or total amount is 1.5 to 8.0%, the balance being Fe, optionally, minor amounts of other intentionally added elements, and unavoidable impurities. The optional other elements which can be intentionally added to or omitted from the alloy include Mo, W, Co, B, Mg, Ca, Re, Y and REM. The superalloy is suitable for forming engine valves, knitted mesh supporters for exhaust gas catalyzers and the like, and has excellent high-temperature strength and normal-temperature ductility after long-time heating, as well as sufficient oxidation resistance properties for these uses.

17 Claims, 1 Drawing Sheet

FE-NI-CR-BASE SUPERALLOY, ENGINE VALVE AND KNITTED MESH SUPPORTER FOR EXHAUST GAS CATALYZER

CROSS-REFERENCE TO RELATED APPLICATION

This application is a continuation-in-part of U.S. application Ser. No. 08/292,019, filed Aug. 18, 1994, now abandoned, the entire disclosure of which is incorporated by reference.

BACKGROUND OF THE INVENTION

The present invention relates to an inexpensive FE—Ni—Cr-base superalloy which is excellent in high-temperature strength, and an engine valve for a motor vehicle and a knitted mesh supporter for an exhaust gas catalyzer for a motor vehicle which are made of the alloy.

In recent years, there has been demand for saving energy and treating exhaust gas to solve the global problems of environmental pollution. It has also been desired to reduce the cost of material for manufacturing-component parts. In order to achieve such objects, there has been a strong demand for reducing the cost of high-quality materials, such as an engine valve material and an exhaust gas mesh material, which are exposed to the highest temperature and the highest stress in an internal combustion engine of a motor vehicle or the like.

Conventionally, as a material for exhaust gas valves of a gasoline engine or a diesel engine, JIS SUH35 (Fe-8.5Mn-21Cr-4Ni-0.5C-0.4N) which is a high-Mn austenitic steel has been widely used. However, in accordance with an increase of the use temperature, JIS NCF751 (Ni-15.5Cr-1Nb-2.3Ti-1.2Al-7Fe), which is an Ni-base superalloy, has started to be employed in some cases. However, JIS NCF751, which contains about 70% Ni, is by far more expensive than JIS SUH35. Therefore, there have been developed alloys which contain less costly alloying elements than JIS NCF751. These less costly alloys are designed to have properties, such as high-temperature strength and stability of alloy structure after long-time heating, which are as close to those of JIS NCF751 as possible.

As a result, there have been made many suggestions such as JP-B2-1-12827, JP-A-62-214149, JP-A-58-189359, JP-A-63-213631, JP-A-61-238942, JP-B2-62-50542, JP-B2-4-11613, JP-A-60-211028 and so on.

As gasoline fuel for engines of motor vehicles, lead-free gasoline has recently been employed for answering the demand for treatment of exhaust gas, and engines for which lead-free gasoline is exclusively used have been mainly produced. For the engine parts which are used at a particularly high temperature, such as engine valves and knitted mesh supporters for exhaust gas catalyzers for a motor vehicle, use of lead-free gasoline leads to an improvement of corrosion environment. If the same level of oxidation resistance property as JIS NCF751 is provided, no consideration need be given to the corrosion resistance property with respect to lead oxide, which has conventionally been a problem to be considered.

On the other hand, in accordance with prolonged guarantee periods for motor vehicles, there has been a need to improve the performance of alloys, particularly in terms of the durability thereof. An alloy, whose strength deterioration and embrittlement after high-temperature long-time use are as small as possible is now in demand.

Of the cost-saving replacements for JIS NCF751, which replacements contain less costly alloying elements, the alloys proposed in JP-A-63-213631, JP-B-2-4-11613 and JP-A-60-211028 can provide high-temperature strength and long-time stability of alloy structure which are close to those of JIS NCF751. However, since the Ni content exceeds 50%, reduction of costs is not sufficiently accomplished as compared with JIS NCF751. The alloys proposed in JP-B2-1-12827, JP-A-62-214149 and JP-A-58-189359 have excellent oxidation resistance and corrosion resistance properties, because Cr content is high. However, unfavorable phases which deteriorate normal-temperature ductility, such as the σ phase and the α' phase rich in Cr precipitate, are present. The alloys proposed in JP-A-61-238942 and JP-B2-62-50542 have low-Ni and low-Al compositions. Consequently, during long-time heating, coarsening of the γ' (gamma prime) phase, which is a precipitation strengthening phase, and transformation from the γ' phase into the η (eta) phase occur, thereby increasing the deterioration of high-temperature strength after long-time heating.

SUMMARY OF THE INVENTION

An objective of the present invention resides in providing a cost-saving FE—Ni—Cr-base superalloy, which is excellent in high-temperature strength and normal-temperature ductility after long-time heating, which could not be accomplished by the above-described conventional alloys, and which has a sufficient oxidation resistance property. Another object of the present invention is to provide an engine valve and a knitted mesh supporter for an exhaust gas catalyzer which are made of this alloy.

In order to predict material deterioration, in actual use, samples were manufactured by heating at 800° C. for 400 hours, and their tensile strength at 800° C. and rotary bending fatigue strength were measured, to thereby measure high-temperature strength of the alloy after long-time heating. Meanwhile, normal-temperature (20° C.) U-notch Charpy impact tests of the samples were performed, and toughness of the material was evaluated from the impact values. In respect of the oxidation resistance property, weight changes after heating at 850° C. for 400 hours in atmospheric air were measured.

Using the foregoing evaluations, novel alloys which contain not more than 50% Ni for saving costly resources and which satisfy the above-mentioned objectives have been invented. The following three features of the present invention are particularly noted.

(1) In the δ' phase consisting of $Ni_3(Al,IVa,Va)$, the ratio of 1.8Al/(Al+Ti+Zr+Hf+V+Nb+Ta), expressed by atomic percent, is increased to stabilize the γ' phase (e.g., this result can be achieved by increasing the Al content alone). On the basis of this idea, the Al content is limited to a range of 1.6 to 3.0% by weight percent. Also, the ratio of Al/(Al+Ti+Zr+Hf+V+Nb+Ta), expressed by atomic percent, is provided in a range of 0.45 to 0.75, so that it becomes possible to prevent deterioration of high-temperature strength owing to transformation from the γ' phase into the η phase or the δ phase during long-time heating which has been a problem of the conventional FE—Ni—Cr-base alloy. Further, such an increase in the Al content serves to increase the amount of generation of $Al_2O_3$ during high-temperature heating, to thereby compensate for deterioration of the oxidation resistance property owing to a decrease in the Cr content described hereinafter in feature (3). Among FE—Ni—Cr-base superalloys containing less than 50% Ni and up to 20% Cr, there exists no conventional alloy having such a high Al content and such a high content of 1.8Al/(Al+Ti+Zr+Hf+V+Nb+Ta). These contents are believed to be quite novel aspects of the present invention.

(2) Deterioration of high-temperature strength owing to a decrease in the Ni content of the matrix is compensated by increasing the amount of the γ' phase. This can be attained by controlling additive amounts of elements of the Group IVa and the Group Va which partially overlap with the elements of the conventional alloy and also by adding a large amount of Al. More specifically, the amount of the γ phase to obtain the intended strength correlates with an amount of (Al+Ti+Zr+Hf+V+Nb+Ta), expressed by atomic percent, and this value (four times this value corresponds to the calculated γ' amount) is controlled to be within a range of 6.5 to 10.0, which is higher than that of the conventional forging alloy, so that short-time high-temperature strength can be improved. Such a high calculated γ' amount has never been realized in actual forging alloys for engine valves, and this high γ' amount is also believed to be a quite novel aspect of this novel invention. In the case of an Ni-base superalloy having not less than 50% Ni, the γ' phase maintains stability up to a particular high temperature, and hot working of the alloy with this level of γ' amount is difficult. Also, in the case of an alloy having a low ratio of Al/(Al+Ti+Zr+Hf+V+Nb+Ta) described in the above-mentioned feature (1), hot working is difficult due to solid-solution strengthening of the IVa family elements and the Va family elements and an increase in the amount of lattice strain of the γ' phase. Therefore, an alloy having such a high calculated γ' amount can be worked only when the Ni content is below 50% and when the ratio of Al/(Al+Ti+Zr+Hf+V+Nb+Ta) described in the above-mentioned feature (1) is high.

(3) In order to prevent precipitation of embrittlement phases rich in Cr, such as the σ phase and the α' phase, after long-time heating, the Cr content of the matrix is suppressed to the minimum amount which will not deteriorate the oxidation resistance property. Further, it is helpful to determine additive amounts of the optional elements, Mo and W (in the same family as Cr), if present, as a total amount of Mo and W, in terms of atomic percent, instead of weight percent. The factors described in the foregoing features (1) and (2), and the determination of the optimum Cr content is further believed to be quite a novel combination. By simultaneously satisfying all three of the above-mentioned features (1), (2) and (3), an alloy which has both the desired strength and ductility after long-time heating can be obtained.

More specifically, according to the present invention, there is provided an FE—Ni—Cr-base superalloy consisting essentially of, by weight, up to 0.15% C, up to 1.0% Si, up to 3.0% Mn, 30 to 49% Ni, 10 to 18% Cr, 1.6 to 3.0% Al, one or more elements selected from the IVa family and the Va family whose amount or total amount is 1.5 to 8.0%, the balance being essentially Fe, optionally accompanied by a minor amount of further intentionally added elements, as well as unavoidable impurities, wherein the one or more elements selected from Group Ira and Group Va satisfy the following formula by atomic percent:

$$0.45 \leqq Al/(Al+Ti+Zr+Hf+V+Nb+Ta) \leqq 0.75.$$

In the present alloy, it is noted that Al is a particularly indispensable additive element. Examples of optional elements, which may be intentionally added to or omitted from the alloy include Mo, W, Co, B, Mg, Ca, Re, Y and REM. However, these optional elements, if present, are only included in minor amounts, e.g., in amounts smaller than any of Fe, Ni or Cr in the alloy. For example, the amount of Mo+W may be not more than 3 wt %. Preferably, the amount of Mo is not more than 2.5 wt %, and the amount of W is not more than 3 wt %. Particularly preferred amounts of the intentionally added and optional elements of the present alloy are described hereinafter.

More preferably, the invention provides an Fe—Ni—Cr-base superalloy consisting essentially of, by weight, up to 0.08% C, up to 0.5% Si, up to 1.0% Mn, 30 to 49% Ni, 13 to 18% Cr, 1.6 to 3.0% Al, 1.5 to 3.0% Ti, 0.3 to 2.5% Nb, the balance being essentially Fe with other optional intentionally added elements and unavoidable impurities.

Still more preferably, the FE—Ni—Cr-base superalloy may contain, by weight, up to 0.08% C, up to 0.2% Si, up to 0.5% Mn, 30 to 45% Ni, 13.5 to 16 Cr, 0.1 to 1.0% Mo, 1.8 to 2.4% Al, 2.0 to 3.0% Ti and 0.5 to 1.5% Nb.

As an optional element, the alloys may include, by weight, up to 5% Co in such a range that Ni+Co≦49%.

Moreover, the above-described alloys preferably contain, by atomic percent, Al and one or more elements selected from Group IVa and Group Va in such a range as to satisfy the following formulas:

$$6.5 \leqq Al+Ti+Zr+Hf+V+Nb+Ta \leqq 10.0$$

$$0.45 \leqq Al/(Al+Ti+Zr+Hf+V+Nb+Ta) \leqq 0.75$$

more preferably, $$6.5 \leqq Al+Ti+Zr+Hf+V+Nb+Ta \leqq 8.5$$

$$0.50 \leqq Al/(Al+Ti+Zr+Hf+V+Nb+Ta) \leqq 0.60$$

Furthermore, the foregoing alloys preferably contain, by atomic percent, Cr, which is an indispensable additive element, and one or both of Mo and W in such a range that 13≦Cr+Mo+W≦18.

The alloys may optionally include, as intentionally added elements, by weight, up to 0.015% B, one or both of up to 0.02% Mg and up to 0.02% Ca, and one or both of up to 0.1% Y and up to 0.1% rare earth elements (hereinafter referred to as REM).

Some of the alloys having these compositions are characterized in that the U-notch Charpy impact value after heating at 800° C. for 400 hours is not less than 0.5 $MJ/m^2$. Further, they are characterized in that the rupture strength in 800° C.-294 MPa a rotary bending fatigue test after heating at 800° C. for 400 hours is not less than $0.5\times10^6$ times, and that the weight change in the oxidation weight loss test of round bars having a diameter of 10 mm and length of 20 mm, measured before and after heating at 850° C. for 400 hours, is not more than 1.6 $mg/cm^2$. Moreover, engine valves for motor vehicles and knitted mesh supporters for exhaust gas catalyzers for motor vehicles which are made of the above-described FE—Ni—Cr-base superalloys have excellent properties which have not been observed in the conventional alloys.

DETAILED DESCRIPTION OF THE INVENTION

Figure 1:
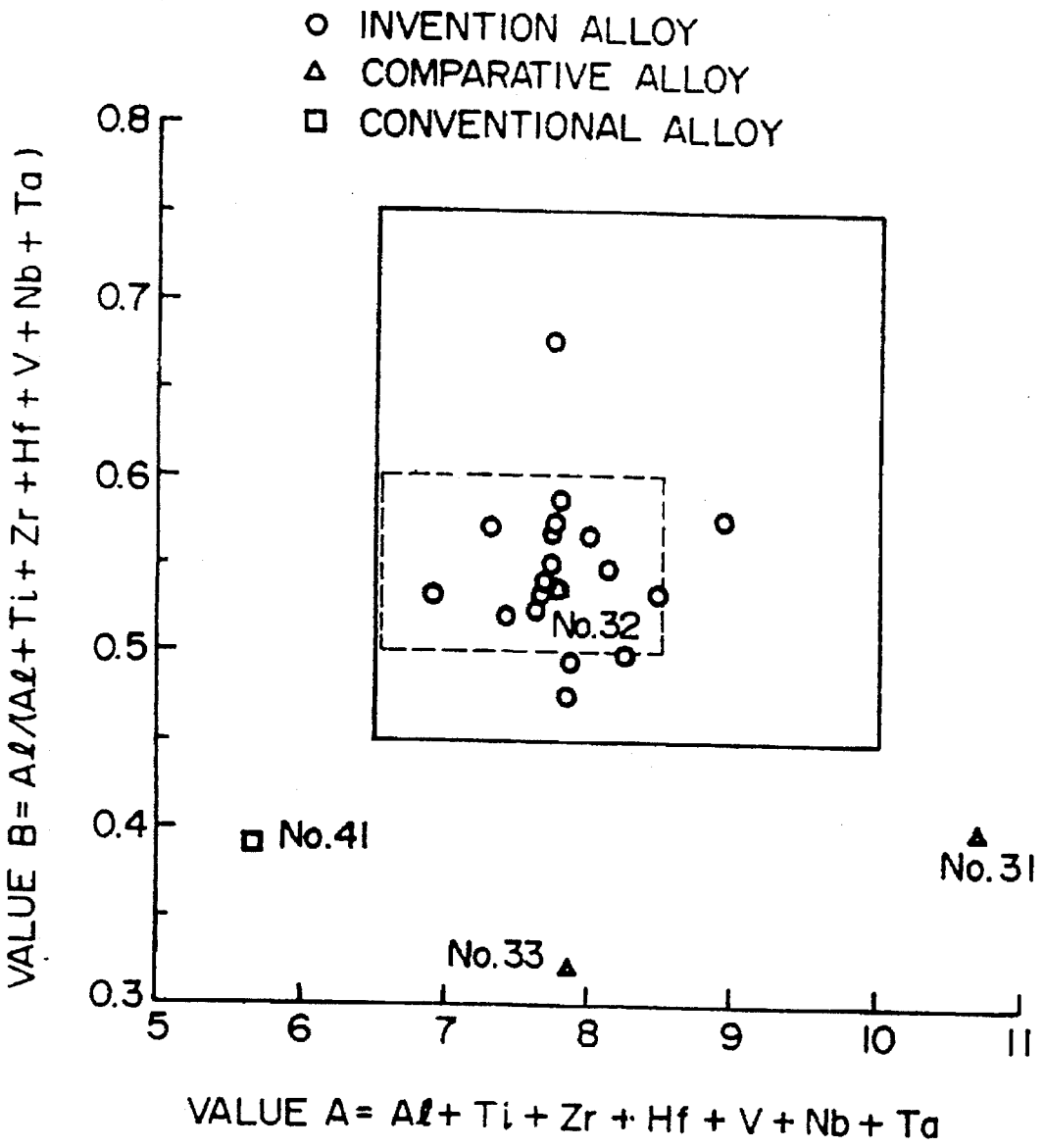
FIG. 1 is a diagram in which the relationship between Al+Ti+Zr+Hf+V+Nb+Ta and Al/(Al+Ti+Zr+Hf+V+Nb+Ta) of invention alloys, comparative alloys and conventional alloys are plotted.

In the present invention, a small amount of carbon must be added, because carbon combines with Ti and Nb and forms carbides, thereby preventing coarsening of crystal grains and improving the creep rupture ductility. However, excessive addition over, e.g., 0.15 wt % of C causes a large amount of decomposition reactions from MC carbides into $M_{23}C_6$ carbides during long-time heating, and deteriorates the ductility on crystal grain boundaries at a normal temperature. Therefore, up to 0.15 wt % C is added. Preferably, up to 0.08 wt % C is added.

Si and Mn may be added to an invention alloy as deoxidizing elements. However, excessive addition of either of them results in deterioration of the high-temperature strength. Therefore, the Si content is limited to 1.0 wt % or less, and the Mn content is limited to 3.0 wt % or less. Preferably, the Si content is 0.5 wt % or less, and the Mn content is 1.0% or less. More preferably, the Si content is 0.2 wt % or less, and the Mn content is 0.5 wt % or less.

Ni stabilizes the austenite phase of the matrix and enhances the high-temperature strength. Further, Ni is an indispensable additive element as a constituent of the γ' phase. When the Ni content is below 30 wt %, precipitation of the γ' phase is insufficient, thereby deteriorating the high-temperature strength. On the other hand, when the Ni content exceeds 49 wt %, the cost of the alloy approaches that of JIS NCF751. Consequently, the Ni content is limited to 30 to 49 wt %. Preferably, the Ni content is 30 to 45 wt %.

Cr is an indispensable element for providing a desired oxidation resistance property for an alloy, and at least 10 wt % Cr is required for ensuring the desired oxidation resistance property for use as heat-resistant parts for a motor vehicle or the like. However, when the Cr content exceeds 18 wt %, the alloy structure becomes unstable, and harmful embrittlement phases such as the α' phase and the G phase rich in Cr are generated, thus deteriorating the creep rupture strength and normal-temperature ductility. Therefore, the Cr content is limited to 10 to 18 wt %. Preferably, the Cr content is 13 to 18 wt %. More preferably, it is 13.5 to 16 wt %.

In the invention, Al is an indispensable element for precipitating the stable gamma prime phase, to thereby obtain a desired high-temperature strength, as described above, and at least 1.6 wt % Al is necessary. However, more than 3.0 wt % Al deteriorates the hot workability. Therefore, the Al content is limited to 1.6 to 3.0 wt %. Moreover, such a high Al content serves to increase an amount of generation of $Al_2O_3$ during high-temperature heating, and contributes to improvement of the oxidation resistance property. Preferably, the Al content is 1.8 to 2.4 wt %. In the category of Fe—Ni-base superalloys containing less than 50 wt % Ni and up to 20 wt % Cr, no alloy having such a high Al content is believed to have ever existed, and this is one of the most significant characteristics of the present invention.

As well as Al elements of the Group IVa and the Group Va family in the alloy of the present invention combine with Ni and precipitate the gamma prime phase so as to enhance the high-temperature strength of the alloy. Totally, not less than 1.5 wt % of one or more of the elements of the Group IVa and the Group Va must be added. However, when the total additive amount of these elements exceeds 8.0 wt %, the gamma prime phase becomes unstable during high-temperature long-time heating, and intermetallic compounds of the η phase and the δ phase which do not conform with the γ phase are easily generated, and also, the hot workability of the alloy is degraded. Consequently, a total of 1.5 to 8.0 wt % of one or more of the elements of the IVa family and the Va family are added. Preferably, the total additive amount of these elements is 3.0 to 5.0 wt %.

Among the elements of the Group IVa, Ti is the most favorable element to be added, and preferably, the additive amount of Ti is 1.5 to 3.0 wt %. More preferably, it is 2.0 to 3.0 wt %. Zr and Hf have lower solubility into the δ phase than Ti, and can not be added as much as Ti. However, Zr and Hf partially segregate on or around crystal grain boundaries and serve to enhance the grain-boundary strength in a high temperature range.

Among the elements of the Group Va, Nb is the most favorable element to be added, and preferably, the additive amount of Nb is 0.3 to 2.5 wt %. More preferably, it is 0.5 to 1.5 wt %. V (vanadium) has a weaker solid-solution strengthening function than Nb and deteriorates the oxidation resistance property, and consequently, excessive addition of V is not favorable. Ta performs solid-solution strengthening of the γ' phase more than Nb. However, Ta is a rare resource and increases the price by a large degree so that a large amount of Ta should not be added.

Mo and W are elements of the same VIa family as Cr, and both Mo and W perform solid-solution strengthening of the austenite matrix and serve to enhance the high-temperature fatigue strength and high-temperature creep rupture strength. Therefore, as optional additive elements, one or both of Mo and W can be added. For example, W may be present in an amount of 3 wt % or less. However, Mo is preferred in respect of the alloy price and the specific gravity, and the preferable Mo content in this case is not more than 2.5 wt %, more preferably, 0.1 to 1.0 wt %. Moreover, precipitation of the α' phase and the α phase is affected by a total amount of these three elements by atomic percent as well as the additive amount of Cr, and consequently, it is preferable to maintain a predetermined value of the total amount of Mo and W in the same family as Cr in terms of atomic percent instead of weight percent. Therefore, the amount of Cr+Mo+W, expressed by atomic percent, is preferably 13 to 18. More preferably, this atomic percent is 15.0 to 17.5.

It is further noted that excessive amounts of Mo in the alloy, especially when Mo is used as a replacement for Cr, may result in a loss of the oxidation resistance property of the alloy. Accordingly, it is preferred to use no more than 2.5 wt % of Mo in the alloy, more preferably 0.1 to 1.0 wt %.

Co dissolves in the austenite matrix and promotes solid solution of the γ' phase in a range for hot working, thereby improving the workability. On the other hand, in a practical temperature range, Co increases an amount of precipitation of the γ' phase and enhances the high-temperature strength. Consequently, Co can be optionally added as a substitute for Ni, if desired, in such a range that Ni+Co≦49 wt %. However, Co is a more expensive element than Ni so that the upper limit is preferably 5.0 wt %.

In order to achieve the object of the present invention, Al the Group IVa elements and the Group Va elements must individually satisfy the foregoing respective ranges. It is also important to realize the total amounts of these elements and the Al content in proper ranges as the gamma prime constituent elements. As described above, in the γ' phase consisting of $Ni_3$(Al,IVa,Va), the ratio of Al/(Al+Ti+Zr+Hf+V+Nb+Ta) expressed by atomic percent, is increased to stabilize the γ' phase. When this ratio of Al/(Al+Ti+Zr+Hf+V+Nb+Ta) is less than 0.45, the high-temperature strength of the alloy is easily deteriorated owing to transformation from the γ' phase into the η phase and the δ phase during long-time heating. On the other hand, when this ratio exceeds 0.75, solid-solution strengthening of the γ' phase is not effected sufficiently, and the normal-temperature strength is deteriorated. Therefore, preferably, this ratio of Al/(Al+Ti+Zr+Hf+V+Nb+Ta) is 0.45 to 0.75. More preferably, this ratio is 0.50 to 0.60.

Further, in order to compensate for deterioration of the high-temperature strength due to a decrease of the Ni content of the matrix with an increase of the amount of the γ' phase, the amount of (Al+Ti+Zr+Hf+V+Nb+Ta), expressed by atomic percent, is preferably controlled in a proper range. When this value is below 6.5 atomic %, the strength is not as high as the strength of the conventional FE—Ni—Cr-base superalloy having more than 50 wt % Ni, and when it exceeds 10 atomic %, hot working for engine valves and the like becomes difficult. Therefore, the amount of (Al+Ti+Zr+Hf+V+Nb+Ta), expressed by atomic percent, is controlled in a range of 6.5 to 10.0, which is higher than the conventional forging alloy, so as to improve the short-time high-temperature strength. The more preferable range is 7.0 to 8.5 atomic %. It is believed that such a high calculated γ' amount has never been realized in a forging alloy for engine valves and the like. In this respect, the present invention is believed to be quite novel. In the case of an Ni-base superalloy having 50 wt % or more Ni, the γ' phase is stable up to a high temperature, and with this amount of γ' phase, hot working for strength of engine valves and the like is difficult.

In the case of an alloy in which the above-mentioned ratio of Al/(Al+Ti+Zr+Hf+V+Nb+Ta), expressed by atomic percent is low, hot working is difficult because of solid-solution strengthening of elements such as Ti, Nb and Ta and an increase of the amount of lattice strain of the γ' phase. Consequently, hot working of an alloy having such a high calculated γ' amount can be conducted only when the Ni content does not exceed 50 wt % and when the ratio of Al/(Al+Ti+Zr+Hf+V+Nb+Ta) is high. Of the atomic percent values shown in the foregoing formulas, those of the elements which are not added are calculated as zero.

In this invention, B (boron) is effective as an optional additive element for enhancing the high-temperature strength and ductility by a grain-boundary strengthening function. Therefore, an appropriate amount of B can be added to the alloy of the present invention. The effect of boron starts to take place from addition of a small amount. However, when the additive amount of B exceeds 0.015 wt %, the solidus temperature during heating is lowered, and the hot workability is degraded. Therefore, the upper limit of B is preferably 0.015 wt %.

Mg and Ca enhance purification of the alloy as strong deoxidizing, desulfurizing elements, and serve to improve the ductility during high-temperature tension, creep deformation and hot working. Consequently, an appropriate amount of one or both of Mg and Ca can be, optionally, added to the alloy. The effect of these elements starts to take place from addition of a small amount. However, when the additive amount of each of Mg and Ca exceeds 0.02 wt %, the solidus temperature during heating is lowered, and the hot workability of the alloy is degraded. Therefore, the upper limit of each of Mg and Ca is preferably 0.02 wt %.

In the present invention, Y and REM are effective for enhancing the high-temperature oxidation resistance property, and an appropriate amount of one or both of Y and REM can be, optionally, added. The effect of these elements starts to take place from addition of a small amount. However, when the additive amount of each of Y and REM exceeds 0.1 wt %, the solidus temperature during heating is lowered, and the hot workability is degraded. Therefore, the upper limit of each of Y and REM is preferably 0.1 wt %. The optimum additive amount of elements of the lanthanoid group, so as to enhance the oxidation resistance property up to the limit, can be easily arrived at by routine experimentation.

Re dissolves in the austenite matrix to strengthen the same. Also, Re promotes precipitation of the γ' phase, and it advantageously improves the high-temperature corrosion resistance property of the alloy. Therefore, up to 2.0 wt % Re may be, optionally, added to the invention alloy. Since Re is a rare resource and increases the alloy price by a large degree, excessive addition is not necessary.

Fe is an effective element for forming the austenite matrix. Fe is inexpensive, particularly in comparison with Ni. Further, Fe softens the matrix in a higher temperature range than Ni, and consequently, hot working can be conducted even if the alloy includes the above-mentioned amounts of strengthening alloy elements. For the foregoing reasons, Fe is the balance of the composition except unavoidable impurities. The alloy may contain, e.g., at least 30 wt % Fe.

Among the impurities, the following elements may be included in an invention alloy if their additive amounts, by weight percent, are within the following ranges:

$$P \leqq 0.04\%,\ S \leqq 0.02\%,\ O \leqq 0.02\%,\ N \leqq 0.05\%$$

more preferably, $$P \leqq 0.02\%,\ S \leqq 0.005\%,\ O \leqq 0.01\%,\ N \leqq 0.01\%$$

The above-described FE—Ni—Cr-base superalloys may be subjected to vacuum melting alone or vacuum melting and the subsequent refining process of electroslag remelting, vacuum arc remelting or the like, and the ingots thus obtained may be processed through hot forging, hot rolling or the like, and finished as primary products.

These materials are adapted for practical use after they are subjected to solid solution heat treatment at 900° to 1100° C. and aging treatment at 600° to 800° C. These treatments are performed for γ' precipitation strengthening for the present superalloy. In the case where hot working also serves as a solid solution heat treatment, aging treatment may be performed directly after hot working.

Sufficient normal-temperature toughness and ductility can be obtained from these alloys even after they are subjected to long-time heat treatment in which practical use is simulated, for example, long-time heating at 800° C. for about 400 hours. These are properties which could not be obtained from the conventional high-Cr FE—Ni—Cr-base superalloys. As a particular property, a Charpy impact value of not less than 0.5 $MJ/m^2$ can be obtained.

These are properties which have recently been taken into consideration, because the durability of conventional component parts must be improved in accordance with prolonged guarantee periods for motor vehicles. If the impact value after heating at 800° C. for 400 hours of a material used for valves of a motor vehicle engine is less than 0.5 $MJ/m^2$, the valves have inadequate toughness and might be broken when, for example, the engine, after long-term use is quickly heated up to a high temperature (e.g., due to the high RPM's achieved by modern engines) in a cold place. Therefore, the impact value of the invention alloy after heating at 800° C. for 400 hours is preferably 0.5 $MJ/m^2$ or more.

Similarly, sufficient fatigue strength can be obtained from the invention alloys even after they are heated at 800° C. for 400 hours. In the case of component parts to which cyclic stress is applied at a high temperature, such as engine valves, the most significant factor which shortens the life of the parts is fatigue. In order to ensure the performance of the valves, in accordance with prolonged guarantee periods for motor vehicles, the rotary bending fatigue rupture strength is preferably to $0.5\times10^6$ times or more Under the test condition of 800° C.-294 MPa after heating at 800° C. for 400 hours. More preferably, the strength is $2.5\times10^6$ times or more. The invention alloys can satisfy such fatigue strength after undergoing the optimum heat treatment for gamma prime precipitation strengthening.

An engine valve is heated to a high temperature level of 800° to 850° C. at the section thereof which is exposed to the highest temperature. Therefore, as stated previously, oxidation resistance is an important property required for engine valves. More particularly, engine valves are generally required to have a level of oxidation resistance at least close to that of NCF751. In the oxidation resistance test hereinafter described, round test bars of respective alloys having a diameter of 10 mm and a length of 20 mm were heated to 850° C. and kept at this temperature for 400 hours. The weight change before and after heating was examined. The oxidation resistance was evaluated with particular regard to a reference level of not greater than 1.6 mg/cm$^2$ of weight change. It is noted that Cr significantly contributes to the improvement of the oxidation resistance of the alloy. However, an excessive amount of Cr causes harmful phases to precipitate in the alloy matrix. Furthermore, Mo and W improve the high temperature strength of the alloy, but these metals deteriorate the oxidation resistance of the alloy. Thus, it is difficult to fulfill all of the types of requirements for engine valve alloys. According to the present invention, however, such requirements are attained by a suitable combination of alloying elements as described above.

The invention alloys can realize both excellent normal-temperature toughness, high-temperature fatigue strength after high-temperature long-time heating and high-temperature oxidation resistance. This is the performance which could not be achieved by the conventional FE—Ni—Cr-base superalloys, and the above-mentioned performance characteristics specifically demonstrate the excellent properties of the invention alloys.

Moreover, hot rolled bars made of the invention alloys may be cut into a required size and shaped into engine valves for motor vehicles through hot upset forging or hot extrusion. Such engine valves are inexpensive resource-saving valves, which are excellent in high-temperature fatigue strength, high-temperature hardness and stability of alloy structure. These valves also have desirable oxidation resistance properties and normal- and high-temperature strength after long-time heating, without requiring building-up on valve face portions. The engine valves can greatly contribute to cost savings in the production of motor vehicles. These engine valves can be subjected to various treatments for surface nitrogenization and various kinds of hard plating before practical use. Also, various kinds of heat-resistant steel and high-hardness alloy tool steel may be welded on the axial portions of the engine valves, and they can be used as connection valves. Further, when the engine valves are processed in various manners and used as hollow engine valves, their durability is further improved.

Furthermore, hot rolled bars made of the invention alloys after solid solution heat treatment may be subjected to cold or warm working and annealing repeatedly, worked into wire having a diameter of about 0.2 mm at the minimum, and shaped into a knitted mesh supporter for supporting a ceramic carrier of an exhaust gas catalyzer. This knitted mesh supporter has more oxidation resistance and high-temperature strength than stainless steel of JIS SUS3105 and the like which is a conventional knitted mesh material, so that a knitted mesh supporter having higher reliability and excellent durability can be obtained.

In the oxidation weight loss test of round bars of the present alloy having a diameter 10 mm and a length of 20 mm measured before and after heating at 850° C. in atmospheric air for 400 hours, the weight change may be not more than 1.6 mg/cm$^2$.

EXAMPLE 1

Alloys of the compositions shown in Table 1 were formed into ingots of 10 kg through vacuum induction melting, and then, the ingots were shaped into bars of 30 mm square through hot working (REM was added as misch metal). The bars were subjected to solid solution heat treatment, in which they were maintained at 1050° C. for 30 minutes and then water-cooled, and then aging treatment, in which they were maintained at 750° C. for 4 hours, and then air-cooled. After this normal heat treatment or after maintaining the bars at this condition at 800° C for 400 hours, normal-temperature hardness, normal-temperature Charpy impact tests, normal-temperature and 800° C. tension tests and rotary bending fatigue tests under the condition of 800° C.-294 MPa were performed. Further, oxidation resistance properties, when the bars were heated at 850° C. for 400 hours in atmospheric air, were inspected. Normal-temperature hardness was measured by Rockwell hardness meters. The Charpy impact tests were performed at a temperature of 20° C. with 2U-notch test pieces No. 3 in accordance with the JIS method. The tension tests were performed with a parallel-portion diameter of 6.35 mm and an elongation of 4D in accordance with the ASTM method. The rotary bending fatigue tests were performed with test pieces having a parallel-portion diameter of 8 mm at a rotational speed of 3600 in accordance with JIS Z2274, and the number of testing operations until each test piece was ruptured was counted. Further, in the oxidation resistance tests, round test bars having a diameter of 10 mm and a length of 20 mm were used, and weights of the test bars were measured before and after heating in atmospheric air at 850° C. for 400 hours, thereby evaluating the oxidization weight changes. Results of the various tests are shown in Table 2.

TABLE 1

| | | COMPOSITION (WEIGHT %) | | | | | | | | | | | | | |
|---|---|---|---|---|---|---|---|---|---|---|---|---|---|---|---|
| | | | | | | | IVa | | | Va | | | VIa | | |
| | No. | C | Si | Mn | Ni | Al | Ti | Zr | Hf | V | Nb | Ta | Cr | Mo | W |
| INVENTION ALLOY | 1 | 0.037 | 0.10 | 0.14 | 39.8 | 1.79 | 2.18 | — | — | — | 1.21 | — | 15.5 | 0.74 | — |
| | 2 | 0.037 | 0.8 | 0.11 | 41.2 | 2.00 | 2.42 | — | — | — | 1.34 | — | 15.0 | 0.74 | — |
| | 3 | 0.035 | 0.08 | 0.11 | 43.1 | 2.20 | 2.68 | — | — | — | 1.47 | — | 14.3 | 0.72 | — |
| | 4 | 0.031 | 0.25 | 0.10 | 44.6 | 2.04 | 2.33 | 0.011 | — | — | 1.25 | — | 15.1 | — | 2.50 |
| | 5 | 0.038 | 0.14 | 0.16 | 41.0 | 1.88 | 2.40 | — | — | — | 1.35 | — | 15.1 | — | — |
| | 6 | 0.013 | 0.18 | 0.12 | 41.3 | 2.04 | 2.44 | — | — | — | 1.31 | — | 16.3 | 0.74 | — |
| | 7 | 0.011 | 0.10 | 0.92 | 41.3 | 2.11 | 1.74 | 0.042 | 0.02 | — | 2.11 | — | 14.8 | 2.50 | 0.31 |
| | 8 | 0.039 | 0.09 | 0.11 | 45.2 | 1.94 | 2.44 | — | — | — | 1.36 | — | 16.3 | 0.76 | — |
| | 9 | 0.037 | 0.08 | 0.11 | 41.5 | 1.89 | 2.76 | — | — | — | 1.35 | — | 15.0 | 0.75 | — |
| | 10 | 0.036 | 0.08 | 0.12 | 41.3 | 2.23 | 2.11 | — | — | — | 1.34 | — | 14.9 | 0.76 | — |
| | 11 | 0.038 | 0.11 | 0.11 | 41.4 | 1.99 | 2.75 | — | — | — | 0.71 | — | 14.9 | 0.75 | — |
| | 12 | 0.035 | 0.10 | 0.11 | 32.3 | 2.05 | 2.79 | — | — | — | 0.70 | — | 14.2 | 0.75 | — |

TABLE 1-continued

| | | | | | | | | | | | | | | | |
|---|---|---|---|---|---|---|---|---|---|---|---|---|---|---|---|
| | 13 | 0.073 | 0.11 | 1.53 | 43.2 | 2.56 | 1.75 | 0.081 | — | — | 0.75 | — | 13.5 | 1.53 | — |
| | 14 | 0.034 | 0.11 | 0.25 | 41.5 | 2.15 | 2.05 | — | 0.06 | — | 0.75 | 1.51 | 15.5 | 0.71 | — |
| | 15 | 0.024 | 0.05 | 0.44 | 42.4 | 2.21 | 2.36 | — | — | — | 1.29 | — | 15.8 | 0.34 | — |
| | 16 | 0.033 | 0.18 | 0.21 | 39.9 | 2.14 | 2.38 | — | 0.11 | — | 1.44 | — | 14.9 | 0.54 | 2.14 |
| | 17 | 0.025 | 0.05 | 0.16 | 43.3 | 2.51 | 2.46 | — | — | — | 1.47 | 0.31 | 14.6 | 0.31 | — |
| | 18 | 0.024 | 0.05 | 0.21 | 42.4 | 1.79 | 2.74 | — | — | — | 1.54 | — | 14.8 | — | 1.44 |
| | 19 | 0.114 | 0.05 | 2.15 | 48.3 | 2.01 | 3.61 | — | — | — | — | — | 11.2 | 0.35 | 0.13 |
| | 20 | 0.035 | 0.62 | 0.25 | 46.6 | 2.02 | 2.03 | 0.012 | 0.03 | 0.38 | 1.03 | 0.54 | 15.2 | — | — |
| | 21 | 0.042 | 0.05 | 0.18 | 45.6 | 2.03 | 2.36 | — | — | 0.22 | — | 0.62 | 16.0 | — | — |
| COMPARATIVE ALLOY | 22 | 0.022 | 0.15 | 0.35 | 46.6 | 1.41 | 2.55 | — | — | — | 0.85 | 0.35 | 15.0 | 1.35 | 0.77 |
| | 23 | 0.009 | 0.13 | 0.25 | 46.8 | 1.25 | 2.06 | 0.008 | — | 0.15 | 0.65 | 0.32 | 16.2 | 0.45 | 0.35 |
| | 31 | 0.015 | 0.25 | 0.35 | 46.0 | 2.05 | 3.62 | 0.060 | 0.12 | 0.35 | 1.54 | 2.51 | 13.2 | 0.25 | — |
| | 32 | 0.042 | 0.08 | 0.12 | 41.3 | 2.04 | 2.45 | — | — | — | 1.34 | — | 18.8 | 0.75 | — |
| | 33 | 0.035 | 0.11 | 0.15 | 41.8 | 1.22 | 3.62 | — | — | — | 1.88 | — | 15.0 | 0.74 | — |
| CONVENTIONAL ALLOY | 41 | 0.035 | 0.16 | 0.13 | 59.9 | 1.07 | 2.49 | 0.019 | — | — | 0.89 | — | 18.6 | — | — |

| | COMPOSITION (WEIGHT %) | | | | | | | | | |
|---|---|---|---|---|---|---|---|---|---|---|
| | | | | | | | | CALCULATED VALUE IN ATOMIC PERCENT | | |
| No. | Fe | Co | B | Mg | Ca | Y | REM | VALUE A | VALUE B | VALUE C |
| 1 | Bal. | 0.21 | 0.0045 | 0.0075 | — | — | — | 6.91 | 0.53 | 16.96 |
| 2 | Bal. | — | 0.0045 | 0.0070 | — | — | — | 7.69 | 0.53 | 16.32 |
| 3 | Bal. | — | 0.0048 | 0.0078 | — | — | — | 8.47 | 0.53 | 15.60 |
| 4 | Bal. | — | 0.0094 | — | 0.0051 | 0.010 | — | 7.72 | 0.55 | 17.03 |
| 5 | Bal. | — | 0.0044 | 0.0033 | — | — | — | 7.41 | 0.52 | 16.05 |
| 6 | Bal. | — | 0.0047 | 0.0077 | — | — | — | 7.77 | 0.54 | 17.72 |
| 7 | Bal. | 2.50 | — | 0.0035 | 0.0021 | — | 0.011 | 7.73 | 0.57 | 17.53 |
| 8 | Bal. | — | 0.0048 | 0.0048 | — | — | — | 7.61 | 0.52 | 17.83 |
| 9 | Bal. | — | 0.0045 | 0.0071 | — | — | — | 7.87 | 0.49 | 16.34 |
| 10 | Bal. | — | 0.0051 | 0.0062 | — | — | — | 7.79 | 0.59 | 16.26 |
| 11 | Bal. | — | 0.0043 | 0.0047 | — | — | — | 7.65 | 0.53 | 16.21 |
| 12 | Bal. | — | 0.0043 | 0.0046 | — | — | — | 7.78 | 0.54 | 15.40 |
| 13 | Bal. | — | — | 0.0033 | 0.0025 | 0.009 | 0.015 | 7.74 | 0.68 | 15.19 |
| 14 | Bal. | — | 0.0041 | — | 0.0051 | — | — | 7.75 | 0.57 | 17.00 |
| 15 | Bal. | — | — | — | — | — | — | 7.99 | 0.56 | 16.94 |
| 16 | Bal. | — | — | — | — | — | — | 8.12 | 0.55 | 17.00 |
| 17 | Bal. | — | — | — | — | 0.010 | — | 8.93 | 0.57 | 15.66 |
| 18 | Bal. | 1.50 | 0.0048 | — | — | — | — | 7.84 | 0.47 | 16.36 |
| 19 | Bal. | — | 0.0025 | — | — | — | — | 8.25 | 0.50 | 12.09 |
| 20 | Bal. | — | — | — | 0.0065 | — | — | 7.67 | 0.54 | 16.11 |
| 21 | Bal. | — | 0.0023 | — | — | — | 0.008 | 7.29 | 0.57 | 16.96 |
| 22 | Bal. | — | 0.0045 | 0.0082 | — | — | — | 6.55 | 0.45 | 17.24 |
| 23 | Bal. | 0.30 | 0.0062 | 0.0035 | — | 0.009 | — | 5.66 | 0.46 | 17.79 |
| 31 | Bal. | — | 0.0044 | 0.0038 | — | — | — | 10.69 | 0.40 | 14.42 |
| 32 | Bal. | — | 0.0046 | 0.0083 | — | — | — | 7.78 | 0.54 | 20.35 |
| 33 | Bal. | — | 0.0045 | 0.0045 | — | — | — | 7.86 | 0.32 | 16.51 |
| 41 | Bal. | — | 0.0047 | 0.0094 | — | — | — | 5.67 | 0.39 | 19.98 |

VALUE A = Al + Ti + Zr + Hf + V + Nb + Ta
VALUE B = Al/(Al + To + Zr + Hf + V + Nb + Ta)
VALUE C = Cr + Mo + W
NOTE:
ATOMIC PERCENT

TABLE 2

| | HARDNESS (HRC) | | NORMAL-TEMPERATURE TENSILE STRENGTH (MPa) | | NORMAL-TEMPERATURE TENSILE REDUCTION OF AREA (%) | | 800° TENSILE STRENGTH (MPa) | |
|---|---|---|---|---|---|---|---|---|
| | NORMAL AGING | OVERAGING | NORMAL AGING | OVERAGING | NORMAL AGING | OVERAGING | NORMAL AGING | OVER-AGING |
| INVENTION ALLOY | | | | | | | | |
| 1 | 35.0 | 33.0 | 1210 | 1113 | 71.6 | 51.3 | 574 | 401 |
| 2 | 36.0 | 35.1 | 1217 | 1175 | 50.8 | 57.6 | 617 | 441 |
| 3 | 38.1 | 37.4 | 1233 | 1216 | 46.7 | 29.8 | 696 | 470 |
| 4 | 36.8 | 35.6 | 1236 | 1187 | 47.3 | 53.0 | 626 | 461 |
| 5 | 38.4 | 34.3 | 1247 | 1154 | 44.1 | 49.5 | 607 | 398 |
| 6 | 37.4 | 35.2 | 1235 | 1195 | 52.7 | 41.7 | 645 | 446 |
| 7 | 35.4 | 34.8 | 1198 | 1155 | 48.8 | 59.0 | 608 | 457 |

TABLE 2-continued

| | | | | | | | | |
|---|---|---|---|---|---|---|---|---|
| 8 | 36.7 | 35.4 | 1232 | 1196 | 49.6 | 43.7 | 651 | 457 |
| 9 | 37.8 | 36.9 | 1248 | 1209 | 47.2 | 38.9 | 644 | 462 |
| 10 | 35.2 | 33.9 | 1209 | 1151 | 52.5 | 48.9 | 600 | 422 |
| 11 | 37.1 | 34.9 | 1231 | 1198 | 48.1 | 46.2 | 631 | 434 |
| 12 | 33.5 | 33.4 | 1162 | 1107 | 55.4 | 46.3 | 566 | 405 |
| 13 | 35.5 | 33.2 | 1219 | 1123 | 72.0 | 60.0 | 579 | 406 |
| 14 | 38.0 | 36.6 | 1236 | 1186 | 44.1 | 47.6 | 638 | 465 |
| 15 | 33.0 | 32.8 | 1137 | 1099 | 64.1 | 58.3 | 555 | 424 |
| 16 | 36.2 | 35.0 | 1209 | 1161 | 51.4 | 55.5 | 597 | 480 |
| 17 | 38.9 | 37.7 | 1288 | 1243 | 40.0 | 28.8 | 726 | 489 |
| 18 | 38.4 | 36.0 | 1265 | 1200 | 45.4 | 38.0 | 648 | 451 |
| 19 | 39.5 | 35.9 | 1325 | 1203 | 42.4 | 33.5 | 688 | 395 |
| 20 | 35.8 | 34.9 | 1220 | 1150 | 45.0 | 48.0 | 589 | 388 |
| 21 | 35.1 | 33.2 | 1215 | 1120 | 70.5 | 52.1 | 565 | 415 |
| COMPARATIVE ALLOY | | | | | | | | |
| 22 | 33.1 | 31.9 | 1164 | 1125 | 75.2 | 64.6 | 548 | 388 |
| 23 | 32.5 | 31.0 | 1145 | 1061 | 78.2 | 76.3 | 530 | 365 |
| 31 | — | — | — | — | — | — | — | — |
| 32 | 37.2 | 36.0 | 1223 | 1197 | 49.7 | 8.1 | 638 | 466 |
| 33 | 39.9 | 34.4 | 1375 | 1078 | 34.1 | 14.4 | 666 | 360 |
| CONVENTIONAL ALLOY | | | | | | | | |
| 41 | 35.5 | 31.8 | 1221 | 1143 | 45.8 | 46.1 | 610 | 424 |

| | 800° C. TENSILE REDUCTION OF AREA (%) | | CHARPY IMPACT VALUE ($MJ/m^2$) | | 800° C.-294 MPa FATIGUE RUPTURE STRENGTH ($\times 10^6$ TIMES) | | OXIDIZATION WEIGHT |
|---|---|---|---|---|---|---|---|
| No. | NORMAL AGING | OVERAGING | NORMAL AGING | OVERAGING | NORMAL AGING | OVERAGING | CHANGE ($mg/cm^2$) |
| 1 | 7.7 | 23.4 | 1.68 | 1.23 | 5.34 | 2.34 | 0.678 |
| 2 | 9.9 | 26.4 | 1.81 | 1.10 | 6.40 | 4.22 | 0.687 |
| 3 | 10.0 | 15.4 | 1.58 | 0.87 | 4.40 | 4.78 | 0.577 |
| 4 | 8.6 | 24.4 | 1.74 | 1.22 | 6.91 | 4.59 | 0.748 |
| 5 | 8.9 | 56.0 | 1.23 | 1.21 | 5.35 | 3.68 | 0.602 |
| 6 | 9.6 | 28.1 | 1.86 | 1.10 | 7.27 | 4.35 | 0.731 |
| 7 | 10.3 | 30.0 | 1.37 | 0.96 | 10.55 | 5.37 | 1.044 |
| 8 | 8.2 | 31.2 | 1.43 | 1.05 | 8.71 | 3.32 | 0.712 |
| 9 | 9.4 | 36.0 | 1.45 | 0.94 | 5.80 | 4.414 | 0.744 |
| 10 | 13.7 | 31.1 | 1.72 | 1.21 | 8.04 | 2.94 | 0.457 |
| 11 | 6.5 | 20.7 | 1.40 | 1.01 | 4.09 | 3.16 | 1.028 |
| 12 | 7.3 | 53.3 | 1.84 | 0.99 | 10.31 | 4.84 | 1.446 |
| 13 | 12.4 | 28.4 | 1.80 | 1.30 | 3.35 | 3.03 | 1.044 |
| 14 | 6.9 | 22.0 | 1.45 | 1.22 | 7.66 | 5.33 | 0.700 |
| 15 | 11.4 | 38.8 | 1.82 | 1.19 | 5.35 | 4.21 | 0.550 |
| 16 | 11.1 | 28.4 | 1.84 | 1.22 | 5.98 | 3.88 | 0.910 |
| 17 | 6.6 | 14.4 | 1.30 | 0.86 | 5.88 | 4.69 | 0.619 |
| 18 | 7.4 | 30.3 | 1.31 | 0.87 | 3.65 | 1.08 | 0.944 |
| 19 | 8.5 | 42.1 | 1.66 | 1.15 | 4.11 | 2.38 | 1.569 |
| 20 | 6.8 | 38.0 | 1.44 | 0.81 | 3.35 | 1.35 | 0.594 |
| 21 | 8.2 | 25.1 | 1.85 | 1.24 | 4.88 | 2.25 | 0.656 |
| 22 | 14.1 | 41.4 | 2.85 | 1.22 | 1.43 | 0.82 | 1.670 |
| 23 | 17.3 | 62.1 | 1.91 | 1.45 | 1.08 | 0.65 | 1.920 |
| 24 | — | — | — | — | — | — | — |
| 25 | 11.2 | 30.4 | 1.32 | 0.16 | 10.17 | 14.21 | 0.742 |
| 26 | 4.4 | 44.1 | 0.84 | 0.43 | 1.05 | 0.33 | 1.944 |
| 27 | 5.5 | 23.6 | 1.21 | 1.09 | 3.24 | 2.26 | 0.876 |

In Table 1, Nos. 1 to 21 are invention alloys, Nos. 22, 23 and 31 to 33 are comparative alloys, and No. 41 is a conventional alloy disclosed in JP-B2-4-11613. Values A, B and C appended to the various chemical compositions in Table 1 are, respectively, an amount of Al+Ti+Zr+Hf+V+Nb+Ta, a ratio of Al/(Al+Ti+Zr+Hf+V+Nb+Ta) and an amount of Cr+Mo+W which are expressed by atomic percent. In calculating these values, the atomic weight of La was used as a representative value of the REM content. Further, the relationship between the values A and B is shown in FIG. 1.

In FIG. 1, the box boardered by continuous lines includes a value A (i.e. atomic % of Al+Ti+Zr+Hf+V+Nb+Ta) of from 6.5 to 10 and a value B [i.e. atomic ratio of Al/(Al+Ti+Zr+Hf+V+Nb+Ta)] of from 0.45 to 0.75. In FIG. 1, the box boardered by broken lines includes a value A of from 6.5 to 8.5 and a value B of from 0.5 to 0.6.

The various kinds of mechanical properties and oxidation resistance properties of the invention alloys were as excellent as or more excellent than those of the conventional alloy No. 41 including 60% Ni. It was confirmed that the invention alloys were superior resource-saving heat-resistant alloys.

Of the comparative alloys, Nos. 22 and 23 had a lower aluminum content that the alloys of the present invention. As a result of this lower aluminum content, these comparative alloys had lower tensile strength (measured at 800° C. after averaging) and fatigue rupture strength (measured under conditions including 294 MPa at 800° C.) and greater oxidation weight change than alloys of the present invention. Cracking occurred in Comparative Alloy. No. 31 during hot forging, and evaluation tests were not performed. This was because the sum of the IVa family and the Va family elements in Table 1 was as high as 8.2%, and because the value A was too high. As shown in FIG. 1, the values A and B of No. 32 were at the same level as those of the invention alloys and had excellent mechanical properties after normal heat treatment. However, the normal-temperature tensile reduction of area and the Charpy impact value after long-time heating were drastically deteriorated. This was because the excessive additive amount of Cr and the excessively high value C resulted in precipitation of the σ phase on crystal grain boundaries. Although No. 33 had excellent mechanical properties after normal heat treatment, the high-temperature tensile strength and the rotary bending fatigue rupture strength after long-time heating were inferior to those of the invention alloys, and the normal-temperature tensile reduction of area and the Charpy impact value were deteriorated by a large degree. This was because the low additive amount of Al and the low value B, as shown in FIG. 1, resulted in coarsening of the γ' phase and transformation from the γ' phase into the η phase during long-time heating.

EXAMPLE 2

The invention alloy No. 2 shown in Table 1 was further subjected to hot forging and cutting and grinding work, and finished as a round bar having a diameter of 6 mm. Then, one end of this round bar was formed into a shape of an engine valve through hot upset forging. This engine valve and a mass-production engine valve made of the conventional alloy (containing 60 wt % Ni) disclosed in JP-B2B-11613 were subjected to the normal heat treatment described in Example 1, and bench tests were carried out with engine testers for lead-free gasoline. Test conditions for high-speed, high-temperature continuous durability tests were selected in such a manner that the maximum temperature of the valve would be 780° to 830° C., and continuous operation for 400 hours was performed. After finishing the tests, shape changes and cross-sectional wear states of the engine valves made of the invention alloy and the conventional alloy were observed, and it was confirmed that both the engine valves had such qualities that they could be provided for practical use without any problems.

EXAMPLE 3

A round bar of 6 mm made of the invention alloy No. 2 in Example 2 was subjected to cold drawing and annealing repeatedly and worked into wire having a diameter of 0.25 mm, and thereafter, the wire was shaped into a knitted mesh supporter of a ceramic carrier for an exhaust gas catalyzer. This catalyzer unit was joined in the bench tests in Example 2, and the performance of the knitted mesh supporter was inspected. Although the temperature of the knitted mesh supporter was higher than that of the valve, the knitted mesh supporter made of the invention alloy did not cause creep deformation nor abnormal oxidization after finishing the tests, and it was found that the invention alloy exhibited an excellent performance in the form of the exhaust gas knitted mesh supporter as well.

As will be apparent from the above, according to the present invention, there can be obtained a resource-saving, inexpensive FE—Ni—Cr-base superalloy which has excellent stability of alloy structure, excellent normal- and high-temperature tensile properties after long-time heating, high-temperature oxidation resistance properties, excellent high-temperature fatigue properties and corrosion resistance properties, and these properties are not inferior to those of an Ni-base superalloy containing 50% or more Ni which is used for engine valves and the like. When engine valves and knitted mesh supporters for exhaust gas catalyzers which are made of this alloy are used for motor vehicle engines, highly reliable engines with excellent durability can be produced, while reducing the cost of the engines.

What is claimed is:

1. An FE—Ni—Cr-base superalloy consisting essentially of, by weight, up to 0.15% C, up to 1.0% Si, up to 3.0% Mn, 30 to 49% Ni, 13 to 18% Cr, 1.6 to 3.0% Al, up to 2.5% Mo, up to 3% W, wherein Mo+W is less than or equal to 3%, one or more elements selected from Groups IVa and Va whose amount or total amount is 1.5 to 8.0%, optionally, up to 5wt % of one or more other intentionally added elements selected from the group consisting of Co, W, B, Mg, Ca, Re, Y and REM, the balance being Fe and unavoidable impurities, wherein said one or more elements selected from said Groups IVa and Va satisfy the following formulae by atomic percent:

$$6.5 \leqq Al+Ti+Zr+Hf+V+Nb+Ta \leqq 10;$$

and $$0.45 \leqq Al/(Al+Ti+Zr+Hf+V+Nb+Ta) \leqq 0.75.$$

2. An alloy according to claim 1 consisting essentially of at least 30 wt % Fe.

3. An alloy according to claim 1, wherein one or both of Mo and W are included in such a range that $13 \leqq Cr+Mo+W \leqq 18$ by atomic percent.

4. An alloy according to claim 1 consisting essentially of, by weight, up to 0.08% C, up to 0.5% Si, up to 10% Mn, 15 to 3.0% Ti and 0.3 to 2.5% Nb.

5. An alloy according to claim 4 consisting essentially of, by weight, up to 0.2% Si, up to 0.5% Mn, 30 to 45% Ni, 13.5 to 16% Cr, 0.1 to 1.0% Mo, 1.8 to 2.4% Al, 2.0 to 3.0% Ti and 0.5 to 1.5% Nb.

6. An alloy according to claim 5 consisting essentially of, by weight, up to 5% Co, wherein $Ni+Co \leqq 49\%$.

7. An alloy according to claim 6 consisting essentially of, by weight, up to 3.0% W, up to 0.015% B, up to 0.02% Mg, up to 0.02% Ca, up to 0.1% Y and up to 0.1% REM.

8. An alloy according to claim 1, wherein said one or more elements selected from said Groups IVa and Va satisfy the following formulae by atomic percent:

$$6.5 \leqq Al+Ti+Zr+Hf+V+Nb+Ta \leqq 8.5;$$

and $$0.50 \leqq Al/(Al+Ti+Zr+Hf+V+Nb+Ta) \leqq 0.60.$$

9. An FE—Ni—Cr-base superalloy consisting essentially of, by weight, up to 0.15% C, up to 1.0% Si, up to 3.0% Mn, 30 to 49% Ni, 13 to 18% Cr, 1.6 to 3.0% Al, up to 2.5% Mo, up to 3% W, wherein $Mo+W \leqq 3\%$, one or more elements selected from Groups IVa and Va whose amount or total amount is 1.5 to 8.0%, up to 5% Co, wherein $Co+Ni \leqq 49$, up to 0.015% B, up to 0.02% Mg, up to 0.02% Ca, up to 2.0% Re, up to 0.1% Y and up to 0.1% REM, the balance being Fe and unavoidable impurities, wherein said Al and said one or more elements selected from said Groups IVa and Va satisfy the following formulae by atomic percent:

$$6.5 \leqq Al+Ti+Zr+Hf+V+Nb+Ta \leqq 10;$$

and $$0.45 \leqq Al/(Al+Ti+Zr+Hf+V+Nb+Ta) \leqq 0.75,$$

and wherein $13 \leqq Cr+Mo+W \leqq 18$ by atomic percent.

10. An alloy according to claim 9, wherein said Al and said one or more elements selected from said Groups IVa and Va satisfy the following formulae by atomic percent:

$$6.5 \leqq Al+Ti+Zr+Hf+V+Nb+Ta \leqq 8.5;$$

and $$0.50 \leqq Al/(Al+Ti+Zr+Hf+V+Nb+Ta) \leqq 0.60.$$

11. An alloy according to claim 10, wherein the following elements are present in the following amounts, in terms of weight percent: up to 0.08% C; up to 0.5% Si; up to 1.0% Mn; 1.5 to 3.0% Ti; and 0.3 to 2.5% Nb.

12. An alloy according to claim 11, wherein the following elements are present in the following amounts, in terms of weight percent: 0.1 to 1.0% Mo; 1.8 to 2.4% Al; 2.0 to 3.0% Ti; and 0.5 to 1.5% Nb.

13. An alloy according to claim 9, wherein the U-notch Charpy impact value after 800° C. for 400 hours is not less than 0.5 $MJ/m^2$, and wherein the rupture strength in the 800° C.-294 MPa rotary bending fatigue test after heating at 800° C. for 400 hours is not less than $0.5 \times 10^6$ times.

14. An alloy according to claim 9, wherein, in the oxidation weight loss test of round bars having a diameter of 10 mm and a length of 20 mm measured before and after heating in air at 850° C. for 400 hours, the weight change is not more than 1.6 $mg/cm^2$.

15. An alloy according to claim 9, which has been subjected to a solid solution heat treatment at 900° C. to 1100° C., followed by an aging treatment at 600° C. to 800° C. to precipitate the gamma prime phase.

16. An engine valve for a motor vehicle which is made from an Fe—Ni—Cr base superalloy consisting essentially of, by weight, up to 0.15% C, up to 1.0% Si, up to 3.0% Mn, 30 to 49% Ni, 10 to 18% Cr, 1.6 to 3.0% Al, up to 2.5% Mo, up to 3% W, wherein $Mo+W \leqq 3\%$, one or more elements selected from Groups IVa and Va whose amount or total amount is 1.5 to 8.0%, up to 5% Co, wherein $Co+Ni \leqq 49$, up to 0.015% up to 0.02% Mg, up to 0.02% Ca, up to 2.0% Re, up to 0.1% Y and up to 0.1% REM, the balance being Fe and unavoidable impurities, wherein said Al and said one or more elements selected from said Groups IVa and Va satisfy the following formulae by atomic percent:

$$6.5 \leqq Al+Ti+Zr+Hf+V+Nb+Ta \leqq 10;$$

and $$0.45 \leqq Al/(Al+Ti+Zr+Hf+V+Nb+Ta) \leqq 0.75,$$

and wherein $13 \leqq Cr+Mo+W \leqq 18$ by atomic percent.

17. A knitted mesh support for an exhaust gas catalyzer for a motor vehicle which is made from an Fe—Ni—Cr base superalloy consisting essentially of, by weight, up to 0.15% C, up to 1.0% Si, up to 3.0% Mn, 30 to 49% Ni, 10 to 18% Cr, 1.6 to 3.0% Al, up to 2.5% Mo, up to 3% W, wherein $Mo+W \leqq 3\%$, one or more elements selected from Groups IVa and Va whose amount or total amount is 1.5 to 8.0%, up to 5% Co, wherein $Co+Ni \leqq 49$, up to 0.015% B, up to 0.02% Mg, up to 0.02% Ca, up to 2.0% Re, up to 0.1% Y and up to 0.1% REM, the balance being Fe and unavoidable impurities, wherein said Al and said one or more elements selected from said Groups IVa and Va satisfy the following formulae by atomic percent:

$$6.5 \leqq Al+Ti+Zr+Hf+V+Nb+Ta \leqq 10;$$

and $$0.45 \leqq Al/(Al+Ti+Zr+Hf+V+Nb+Ta) \leqq 0.75,$$

and wherein $13 \leqq Cr+Mo+W \leqq 18$ by atomic percent.

* * * * *